US010840630B2

(12) United States Patent
Wuerker et al.

(10) Patent No.: US 10,840,630 B2
(45) Date of Patent: Nov. 17, 2020

(54) CONTACT DEVICE AND CONTACT SYSTEM

(71) Applicant: TE Connectivity Germany GmbH, Bensheim (DE)

(72) Inventors: Robert Wuerker, Frankfurt am Main (DE); Dominik Klingler, Heppenheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/506,103

(22) Filed: Jul. 9, 2019

(65) Prior Publication Data

US 2020/0014139 A1 Jan. 9, 2020

(30) Foreign Application Priority Data

Jul. 9, 2018 (DE) ..... 10 2018 116 566

(51) Int. Cl.
*H01R 13/42* (2006.01)
*H01R 13/424* (2006.01)
*H01R 13/24* (2006.01)

(52) U.S. Cl.
CPC ..... *H01R 13/424* (2013.01); *H01R 13/2442* (2013.01)

(58) Field of Classification Search
CPC ..... H01R 13/2442; H01R 13/424
(Continued)

(56) References Cited

U.S. PATENT DOCUMENTS 2,549,589 A * 4/1951 Flynn ..... H01R 11/24 439/729
4,071,289 A * 1/1978 Szudarek ..... H01R 12/592 439/495

(Continued)

FOREIGN PATENT DOCUMENTS

CN 102439791 A 5/2010
DE 10108071 A1 5/2002

(Continued)

OTHER PUBLICATIONS

Extended European Search Report, European Patent Application No. 19184980.1, dated Nov. 18, 2019, 9 pages.

(Continued)

*Primary Examiner* — Abdullah A Riyami
*Assistant Examiner* — Vladimir Imas
(74) *Attorney, Agent, or Firm* — Barley Snyder

(57) ABSTRACT

A first contact device is adapted to fasten to a second contact device of a contact system. The first contact device includes a first contact housing having a first contact receptacle, an actuating unit adapted to be swiveled between a first position and a second position different from the first position, and a contact element arranged in the first contact receptacle and electrically connected to an earthing line. The first contact housing is connected to the actuating unit. The contact element has a contact spring arranged in the first contact receptacle in the first position and, in the second position, the actuating unit adjoins the contact spring. The contact spring is swiveled at least partially out of the first contact receptacle and contacts a shielding contact of the second contact device.

30 Claims, 12 Drawing Sheets

(58) Field of Classification Search
USPC ..... 439/729
See application file for complete search history.

(56) References Cited

U.S. PATENT DOCUMENTS 4,711,508 A * 12/1987 Sueyoshi ..... H01R 13/4223 439/595
4,767,361 A * 8/1988 Hoshino ..... H01R 13/422 439/596
4,867,705 A * 9/1989 Yuasa ..... H01R 13/4223 439/595
5,002,504 A * 3/1991 Carlson ..... H01R 13/506 439/595
5,046,965 A * 9/1991 Neese ..... A61B 5/0448 439/372
5,051,100 A * 9/1991 Kato ..... H01R 13/4538 439/137
5,076,806 A * 12/1991 Hotea ..... H01R 13/42 439/278
5,147,222 A * 9/1992 Hotea ..... H01R 13/5205 439/589
5,232,373 A * 8/1993 Sawada ..... H01R 13/641 439/140
5,292,262 A * 3/1994 Endo ..... H01R 13/4223 439/595
5,306,195 A * 4/1994 Hayashi ..... H01R 13/5208 439/467
5,454,739 A * 10/1995 Strand ..... A61B 5/0416 439/729
5,643,009 A * 7/1997 Dinkel ..... H01R 13/424 439/595
5,746,628 A * 5/1998 Yamamoto ..... H01R 13/4362 439/595
5,895,285 A * 4/1999 Okabe ..... H01R 13/501 439/400
6,024,605 A * 2/2000 Beck, Jr. ..... H01R 13/424 439/595
6,109,975 A * 8/2000 Nitta ..... H01R 33/06 439/596
6,551,145 B2 * 4/2003 Kurimoto ..... H01R 13/4362 439/595
6,655,999 B2 * 12/2003 Mase ..... H01R 13/4223 439/595
7,011,553 B2 * 3/2006 Hayashi ..... H01R 13/4367 439/460
7,214,107 B2 * 5/2007 Powell ..... H01R 11/22 439/729
7,572,142 B2 * 8/2009 Katsuma ..... H01R 13/4367 439/352
7,682,205 B2 * 3/2010 Hall ..... H01R 13/4361 439/752
8,098,205 B2 1/2012 Rabinovich et al.
8,895,876 B2 * 11/2014 Makino ..... H01R 13/46 174/520
9,142,904 B2 * 9/2015 Martin ..... H01R 13/40
9,153,894 B2 * 10/2015 Gerwatowski ..... H01R 13/4223
9,270,044 B2 * 2/2016 Hara ..... H01R 12/714
9,337,561 B2 * 5/2016 Panitz ..... H01R 13/02
9,620,883 B2 * 4/2017 Oomori ..... H01R 43/28
9,647,378 B1 * 5/2017 Mingo ..... H01R 13/5045
9,667,002 B1 * 5/2017 Martin ..... H01R 13/432
9,748,690 B2 * 8/2017 Sasaki ..... H01R 13/6272
9,819,114 B2 * 11/2017 McCorkle ..... H01R 13/5213
9,893,462 B2 * 2/2018 Hashimoto ..... H01R 11/11
9,960,550 B2 * 5/2018 Ensley ..... H01R 13/424
2002/0048976 A1 * 4/2002 Zhu ..... H01R 12/725 439/108
2002/0081883 A1 * 6/2002 Hotea ..... H01R 12/79 439/260
2003/0157836 A1 * 8/2003 Morikawa ..... H01R 13/6275 439/607.41
2007/0037447 A1 * 2/2007 Gimbel ..... H01R 9/00 439/607.01
2010/0277379 A1 11/2010 Lindackers et al.

FOREIGN PATENT DOCUMENTS

EP 2020707 A1 2/2009
WO 9215129 A1 9/1992
WO 2008083167 A1 7/2008
WO 2010029305 A1 3/2010
WO 2010129628 A1 11/2010

OTHER PUBLICATIONS

Abstract DE 10108071 A1, dated May 23, 2002, 1 page.
German Office Action, German App No. 10 2018 116 566.8, dated Apr. 2, 2019, 5 pages.
Indian Examination Report, App No. 201644027597, dated Apr. 6, 2020, 6 pages.

* cited by examiner

CONTACT DEVICE AND CONTACT SYSTEM

CROSS-REFERENCE TO RELATED APPLICATIONS

This application claims the benefit of the filing date under 35 U.S.C. § 119(a)-(d) of German Patent Application No. 102018116566.8, filed on Jul. 9, 2018.

FIELD OF THE INVENTION

The present invention relates to a contact device and, more particularly, to a contact device with an earthing connection.

BACKGROUND

A contact device with an earthing connection is disclosed in WO 2008/083167 A1.

SUMMARY

A first contact device is adapted to fasten to a second contact device of a contact system. The first contact device includes a first contact housing having a first contact receptacle, an actuating unit adapted to be swiveled between a first position and a second position different from the first position, and a contact element arranged in the first contact receptacle and electrically connected to an earthing line. The first contact housing is connected to the actuating unit. The contact element has a contact spring arranged in the first contact receptacle in the first position and, in the second position, the actuating unit adjoins the contact spring. The contact spring is swiveled at least partially out of the first contact receptacle and contacts a shielding contact of the second contact device.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
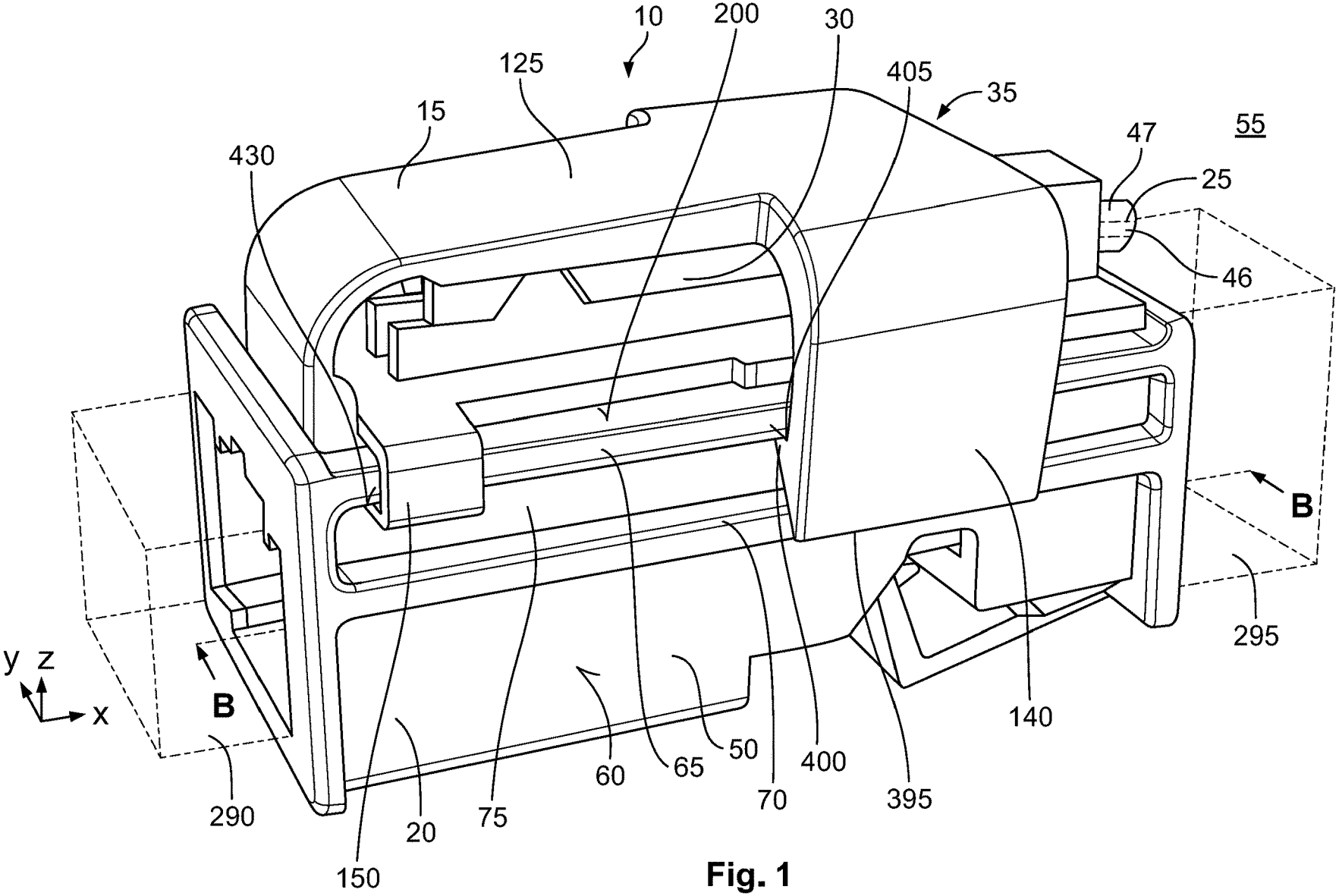
FIG. 1 is a perspective view of a contact system according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the figures below, reference is made to a coordinate system. The coordinate system is configured as a right-handed system, by way of example, and comprises an x-axis (longitudinal direction), a y-axis (transverse direction), and a z-axis (vertical direction).

A contact system 10 according to an embodiment, as shown in FIG. 1, comprises a first contact device 15 and a second contact device 20. In the shown embodiment, the second contact device 20 is arranged on a lower side of the first contact device 15. The contact system 10 serves to connect a first shielded cable 290 to a second shielded cable 295. The first shielded cable 290 and the second shielded cable 295 are shown schematically in FIG. 1 with dashed lines. The second contact device 20 forms a coupler for connecting the first shielded cable 290 to the second shielded cable 295. In other embodiments, a different configuration of the second contact device 20 is, of course, conceivable.

As shown in FIG. 1, the first contact device 15 is connected, in an interlocking manner, to the second contact device 20. The first contact device 15 is connected to an earthing line 25. The earthing line 25 can be connected to an electrical earth, e.g. to a body of a motor vehicle.

The first contact device 15 has a first contact housing 30, an actuating unit 35, and a contact element 40 covered in FIG. 1 by the first contact housing 30. The earthing line 25 is guided into the first contact housing 30 and has a casing 47 and a first electrical conductor 46, with the first electrical conductor 46 being electrically connected to an electrical earth. The casing 47 encases the first electrical conductor 46 at the circumference and electrically insulates the first electrical conductor 46 with respect to an environment 55 of the contact system 10.

The second contact device 20, as shown in FIG. 1, has a shielding 250 that is covered and a second contact housing 50. The second contact housing 50 has a rectangular basic shape, in an exemplary embodiment. The second contact housing 50 has a first lateral surface 60 extending substantially in an xz-plane. The second contact housing 50 has a first housing protrusion 65 on the first lateral surface 60. The first housing protrusion 65 is subsequently arranged in the z-direction at an upper side 260 of the second contact housing 50. The first housing protrusion 65 protrudes out over the first lateral surface 60 laterally in the transverse direction. The first housing protrusion 65 is formed in the shape of a rib. A second housing protrusion 70 can be arranged below the first housing protrusion 65, with the second housing protrusion 70 being formed identically to the first housing protrusion 65 in an embodiment. The second housing protrusion 70 runs parallel to the first housing protrusion 65. The first housing protrusion 65 and the second housing protrusion 70 delimit a housing receptacle 75 on the upper side and lower side. The housing receptacle 75 is delimited by the first lateral surface 60 in the transverse direction. The first lateral surface 60 is thus interrupted in the vertical direction by the second housing protrusion 70.

Figure 2:
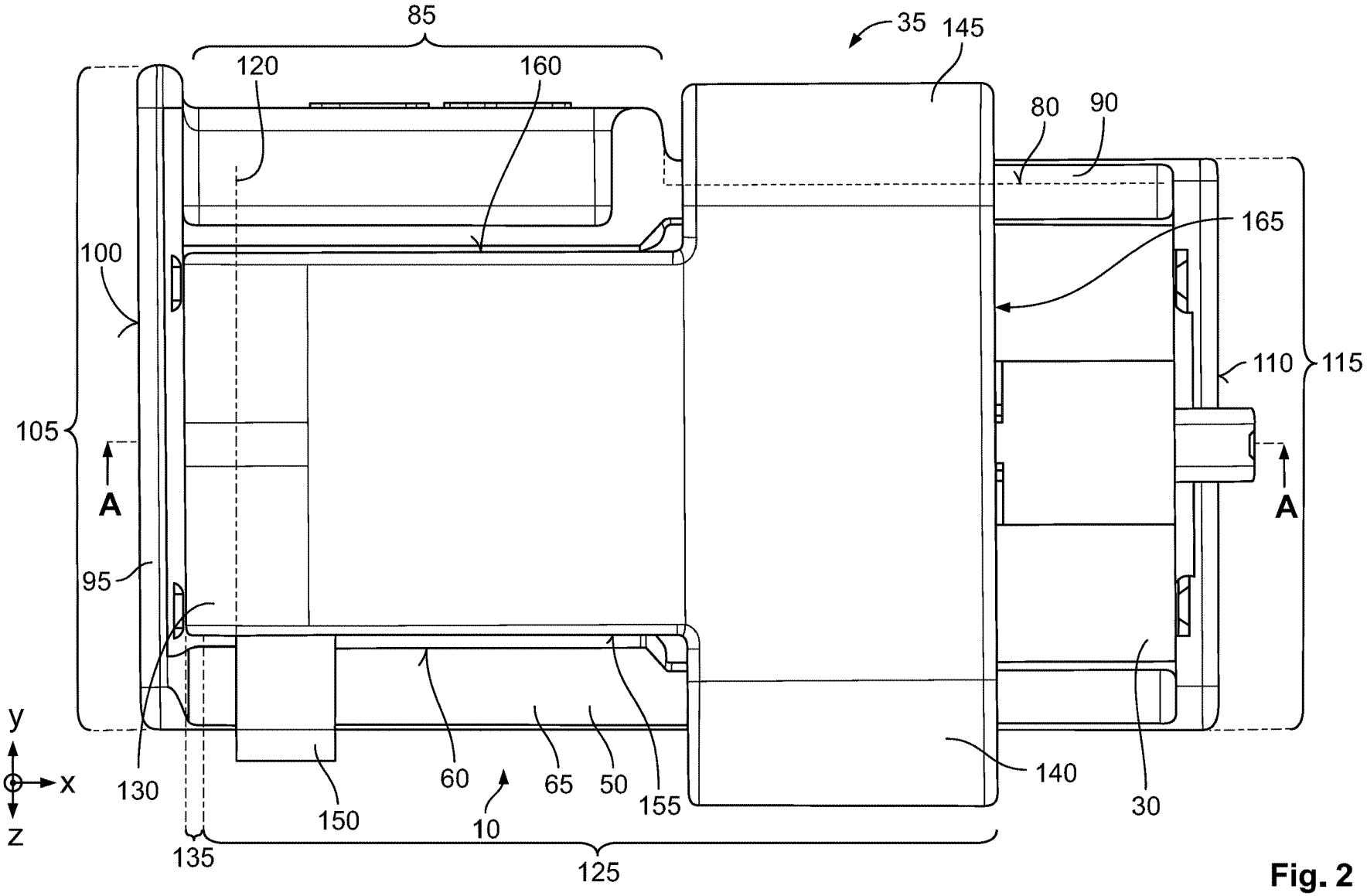
FIG. 2 is a top view of the contact system.

The second contact housing 50, as shown in FIG. 2, has a second lateral surface 80 opposite the first lateral surface 60 in the y-direction, and a protrusion section 85 bordering the second lateral surface 80 in the longitudinal direction. The second lateral surface 80 is aligned parallel to the first lateral surface 60. The second contact housing 50 has, on the second lateral surface 80, a third housing protrusion 90 which is formed identically to the first housing protrusion 65 in the vertical direction and transverse direction. The third housing protrusion 90 also is formed in the shape of a rib. The first housing protrusion 65 and the third housing protrusion 90 extend in a common xy-plane. In the y-direction, the protrusion section 85 is formed wider than the third housing protrusion 90. The third housing protrusion 90 ends at the protrusion section 85 in the longitudinal direction.

As shown in FIG. 2, the second contact housing 50 has on the upper side, by way of example, a circumferential edge 95. The edge 95 is arranged on the second contact housing 50 completely circumferentially on the upper side. In other embodiments, the edge 95 can be interrupted. The edge 95 is formed in a first partial section by the first housing protrusion 65. In the transverse direction in an opposing manner, the edge 95 is formed in a second partial section by the protrusion section 85 and the third housing protrusion 90. At a first end face 100, the second contact housing 50 has a first end section 105, which is formed in a plate-like manner and extends substantially in the transverse direction. At a second end face 110 opposite the first end face 100, the second contact housing 50 has a second end section 115 formed in a plate-like manner. The first end section 105 and the second end section 115 extend in the transverse direction over the entire width of the second contact housing 50. The first end section 105 and the second end section 115 form the edge 95 in the transverse direction in a third and fourth partial section.

On a side facing the first end face 100, the actuating unit 35 is connected to the first contact housing 30 by a hinge 135, as shown in FIG. 2. The actuating unit 35 can be swiveled between a first position (unlocking position) and a second position (locking position) around a swivel axis 120. The swivel axis 120 runs parallel to the first end face 100 and extends parallel to the y-axis. The actuating unit 35 is depicted in the second position (locking position) in FIG. 2. The actuating unit 35 has an actuating bracket 125 formed, by way of example, in the shape of a plate. The actuating bracket 125 is connected to the hinge 135 at a first fixed end 130, which is arranged on a side facing the first end face 100. The actuating unit 35, the hinge 135, and the first contact housing 30 are monolithically formed in a single piece and with uniform material in an embodiment, for example in an injection molding, for example from a plastic.

Figure 3:
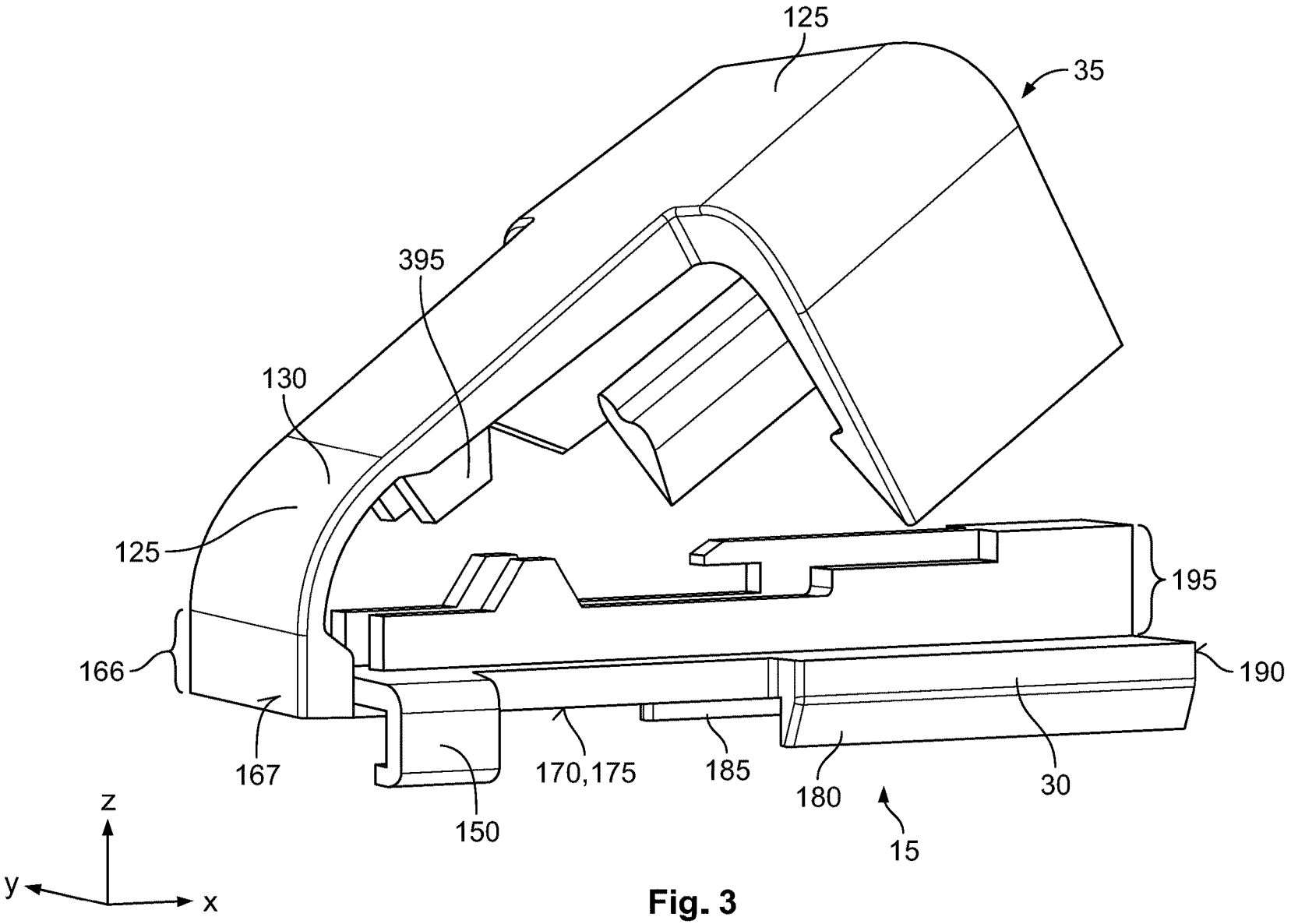
FIG. 3 is a perspective view of a first contact housing of the contact system.

The hinge 135 can be formed in the style of a film hinge, for example. The hinge 135 can also be formed, for example, as shown in FIG. 3, as a thinned portion of material in the actuating bracket 125 at the first fixed end 130. The thinned portion of material can also be omitted, if a material of the actuating bracket 125 can be deformed in an elastically reversible manner in the region of the hinge 135. In the second position, the actuating bracket 125 is folded onto the first contact housing 30.

The actuating unit 35, as shown in FIG. 2, has a first holding element 140, a second holding element 145, and a third holding element 150. The number of holding elements 140, 145, 150 is merely exemplary. In other embodiments, the number of holding elements 140, 145, 150 can also be larger or smaller with respect to the configuration of the contact system 10 shown in FIG. 2.

As shown in FIG. 2, the first holding element 140 is arranged at a first side 155 of the actuating bracket 125. The first side 155 is arranged on a side of the actuating bracket 125 facing the first lateral surface 60. The second holding element 145 is arranged on a second side 160 opposite the first side 155 in the transverse direction. The first holding element 140 and the second holding element 145 are further arranged bordering a first free end 165 of the actuating bracket 125. The first holding element 140 and the second holding element 145 are connected to the actuating bracket 125. In this case, the first holding element 140 and the second holding element 145 are arranged in an overlapping manner in the longitudinal direction. An overlap in the longitudinal direction is understood to mean that, in the case of a projection in the y-direction into a projection plane, which is formed as an xz-plane, the two components, in the embodiment here the first holding element 140 and the second holding element 145 cover one another in the projection plane. In other words, the first holding element 140 and the second holding element 145 are arranged at the same height in the longitudinal direction.

The first contact device 15, as shown in FIG. 2, has a third holding element 150. The third holding element 150 is arranged laterally at the first contact housing 30 in the longitudinal direction on a side facing the first fixed end 130 and on a side facing the first side 155 in the transverse direction. The third holding element 150 is formed shorter than the first holding element 140 and the second holding element 145 in the longitudinal direction, by way of example. The third holding element 150 is further arranged at a distance from the first holding element 140 and the second holding element 145.

The first contact housing 30, as shown in FIG. 3, has a first housing element 166. The first housing element 166 is formed substantially in the shape of a plate and extends substantially in the xy-direction. The first housing element 166 is connected to the first fixed end 130 of the actuating bracket 125 at a third end face 167. The actuating unit 35 is depicted in the first position (unlocking position) in FIG. 3. In the first position, the actuating bracket 125 is arranged swiveled away from the first contact housing 30 and at a distance from the first contact housing 30.

The first contact housing 30, as shown in FIG. 3, has a second housing element 195 on the upper side of the first housing element 166. The second housing element 195 is formed slimmer than the first housing element 166 in the transverse direction. The second housing element 195 has a substantially rectangular configuration. The first housing element 166 and the second housing element 195 are monolithically formed in a single piece and with uniform material. The first housing element 166 has a bearing surface 175 on a lower side 170. The bearing surface 175 is formed in a substantially planar manner and extends in an xy-plane.

On the lower side 170, as shown in FIG. 3, the first contact housing 30 has a first holding bar 180 and a second holding bar 185. The first holding bar 180 and the second holding bar 185 are arranged at a distance from the third holding element 150. The holding bar 180, 185 protrudes out over the bearing surface 175 on the lower side. The holding bar 180, 185 is formed in a rectilinear manner and extends substantially in its main extension direction in the longitudinal direction. In this case, the holding bar 180, 185 ends on a fourth end face 190 of the first contact housing 30 facing the second end face 110.

Figure 4:
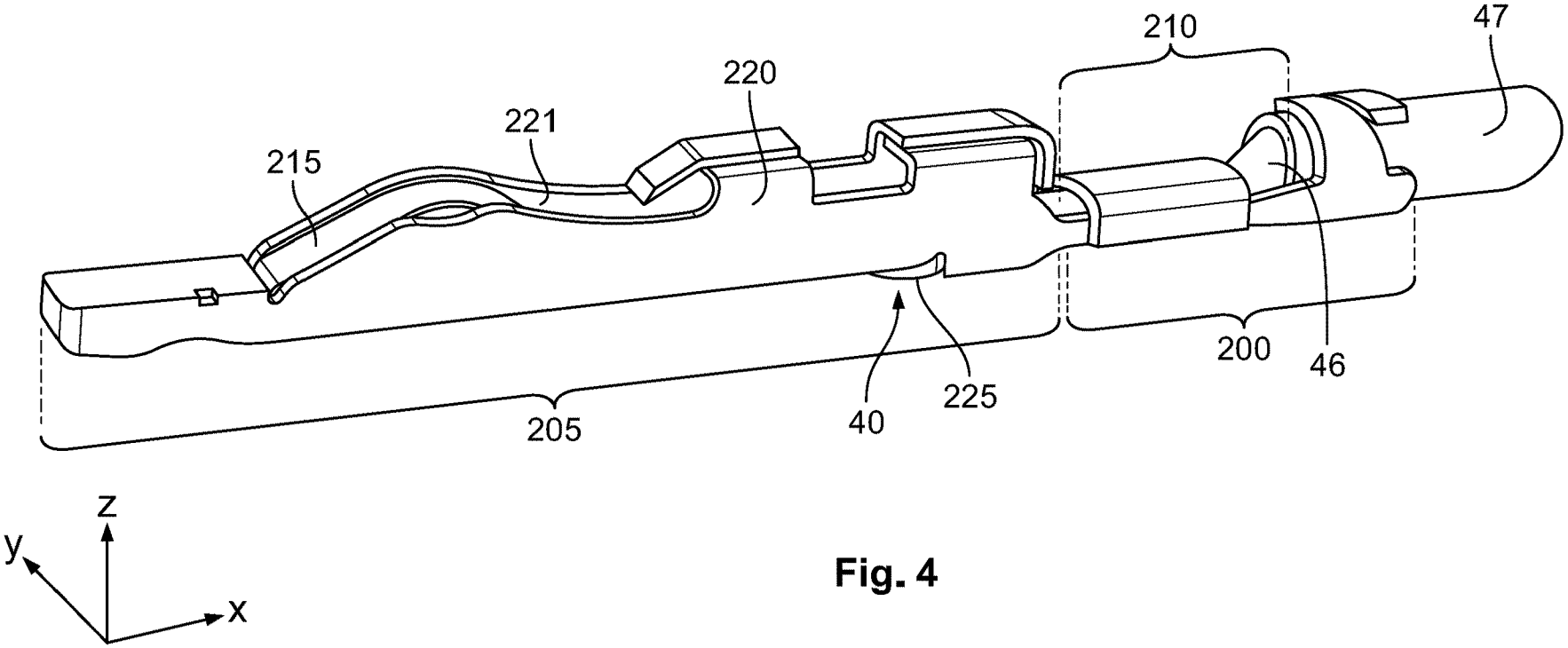
FIG. 4 is a perspective view of a contact element of the contact system.
Figure 9:
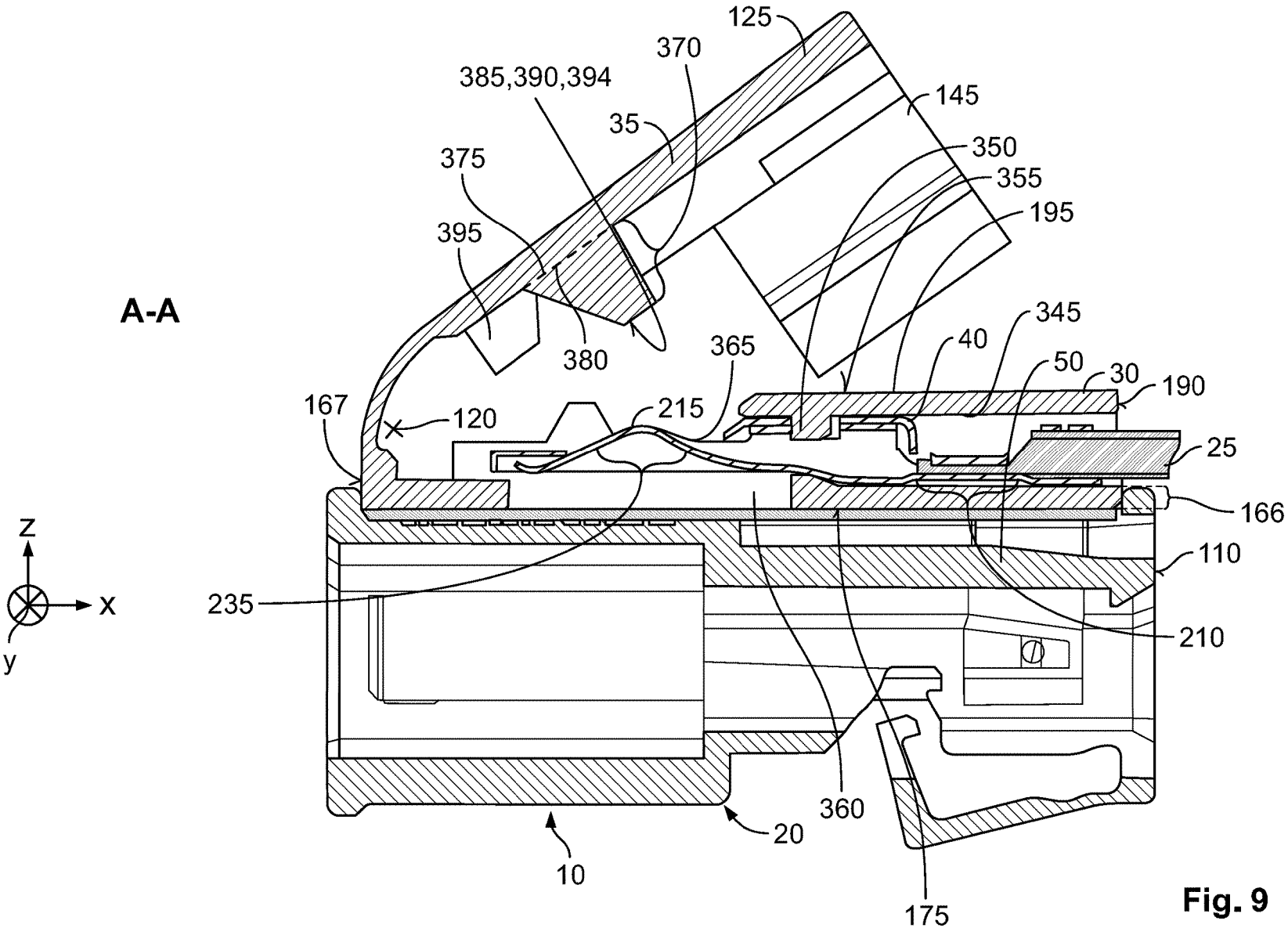
FIG. 9 is a sectional side view of the contact system, taken along plane A-A of FIG. 2.

The contact element 40, as shown in FIG. 4, is arranged in a first contact receptacle 345, shown in FIG. 9, and has a connecting section 200 and a contacting section 205 associated with the connecting section 200. The connecting section 200 is associated with an end region 210 of the first electrical conductor 46. In an embodiment, in the end region 210, the first electrical conductor 46 is not enclosed by the casing 47 on the outer side. The first electrical conductor 46 can be crimped to the connecting section 200, for example.

The contacting section 205, as shown in FIG. 4, has a contact spring 215 and a contact enclosure 220. The contact spring 215 is connected to the contact enclosure 220 at a second fixed end 225. The contact enclosure 220 delimits a contact interior 221. The contact spring 215 is arranged in the interior 221. The contact enclosure 220 engages around the contact spring 215 laterally. In a third position, the contact spring 215 is electrically and mechanically connected to the contact enclosure 220.

Figure 5:
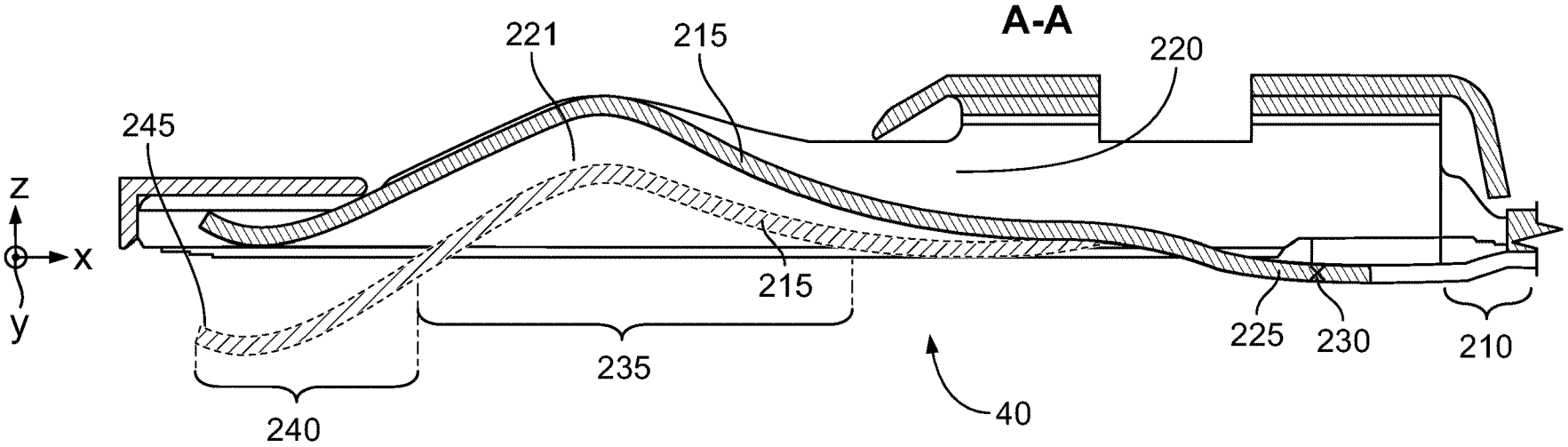
FIG. 5 is a sectional side view of the contact element, taken along plane A-A of FIG. 2.

As shown in FIG. 5, the second fixed end 225 of the contact spring 215 is arranged on a side of the contact spring 215 facing the connecting section 200. The contact spring 215 can be swiveled between the third position (a solid line in FIG. 5) and a fourth position (a dashed line in FIG. 5) around a second swivel axis 230. The second swivel axis 230 runs parallel to the y-axis and parallel to the swivel axis 120. In the third position, the contact spring 215 is arranged inside the contact interior 221. In the fourth position, the contact spring 215 is swiveled downwards out of the contact interior 221.

The contact spring 215 has a substantially S-shaped configuration. The contact spring 215, as shown in FIG. 5, has a first spring section 235 and a second spring section 240. The first spring section 235 borders the second spring section 240 in the longitudinal direction. The first spring section 235 and the second spring section 240 are furthermore connected to one another. The first spring section 235 is arranged on a side of the contact spring 215 facing the second fixed end 225. The second spring section 240 borders a second free end 245 of the contact spring 215. The first spring section 235 and the second spring section 240 have a curvature running opposite one another in each case. In this case, the first spring section 235 is curved downwards, such that a first centre of curvature is arranged below the first spring section 235. The second spring section 240 is curved upwards, with a second centre of curvature for the second spring section 240 arranged above the second spring section 240. In this case, the second spring section 240 is formed in a convex manner with respect to the first spring section.

Figure 6:
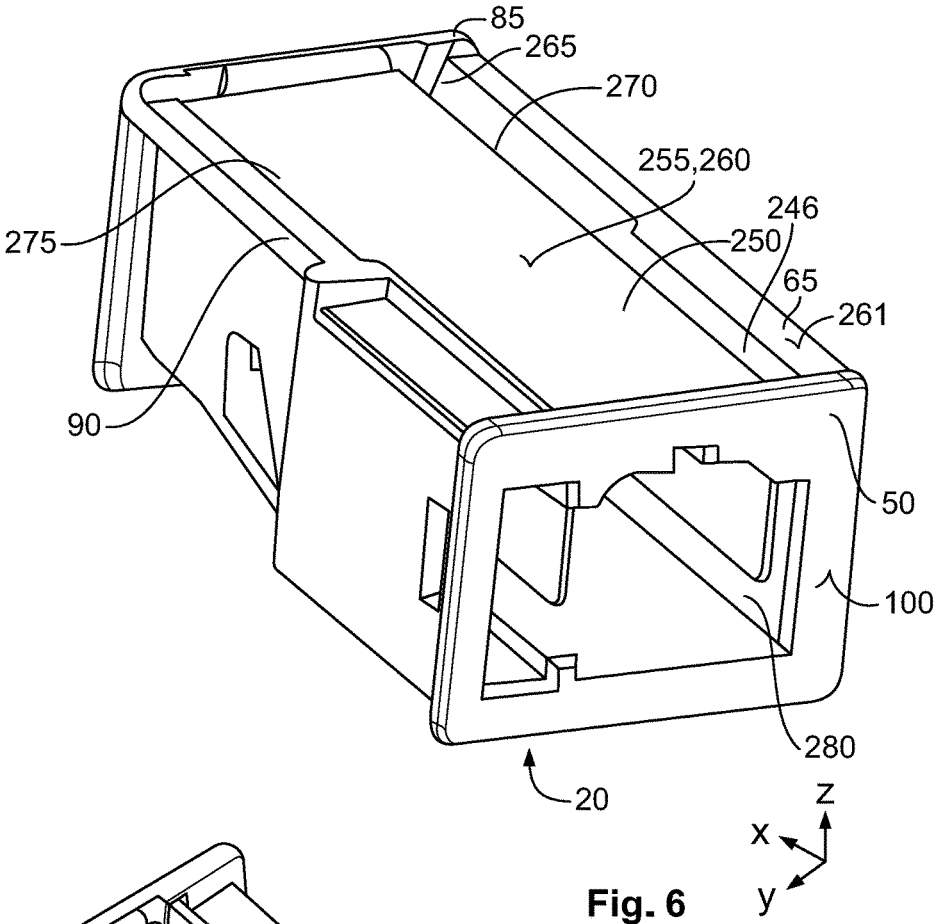
FIG. 6 is a perspective view of a second contact device of the contact system.

As shown in FIG. 6, the second contact housing 50 has a second contact receptacle 246. The shielding 250 is arranged in the second contact receptacle 246. The shielding 250 has a substantially U-shaped configuration and is arranged in the second contact housing 50. The shielding 250 extends predominantly in the longitudinal direction over the entire longitudinal extent of the second contact housing 50. In an embodiment, the shielding 250 extends over at least 80% of the entire longitudinal extent of the second contact housing 50. The shielding 250 has a shielding contact 255. The shielding contact 255 is formed by a plate-shaped configuration of a shielding section, which is arranged and accessible at an upper side 260 of the second contact device 20. The shielding contact 255 is formed in a substantially planar manner. The shielding contact 255 is surrounded by the edge 95 at the circumference. The shielding contact 255 is arranged in a downwardly offset manner with respect to an upper side 261 of the edge 95. The shielding contact 255, together with the edge 95, delimits a receptacle 265. The receptacle 265 is open in the upward direction, insofar as the first contact device 15 is not fastened to the second contact device 20.

The second contact device 20, as shown in FIG. 6, has a first recess 270 between the first housing protrusion 65 and the shielding 250, and, in the transverse direction in an opposing manner, has a second recess 275 between the shielding 250 and the third housing protrusion 90. The second contact housing 50 has a first contact device receptacle 280. The first contact device receptacle 280 opens out at the first end face 100.

Figure 7:
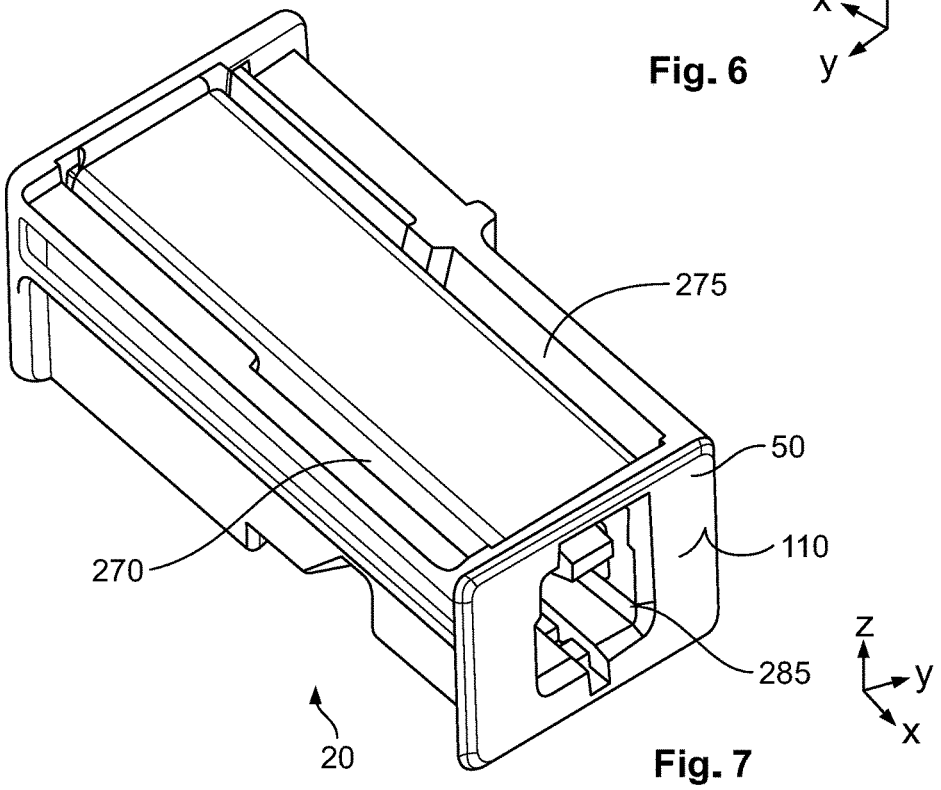
FIG. 7 is a perspective view of the second contact device.

The second contact housing 50, as shown in FIG. 7, has a second contact device receptacle 285. The second contact device receptacle 285 is connected to the first contact device receptacle 280 on the inside in the second contact housing 50. The second contact device receptacle 285 opens out at the second end face 110. The first recess 270 and the second recess 275 are arranged on a side facing the second end face 110 and extend approximately over half the longitudinal extent of the second contact housing 50.

Figure 8:
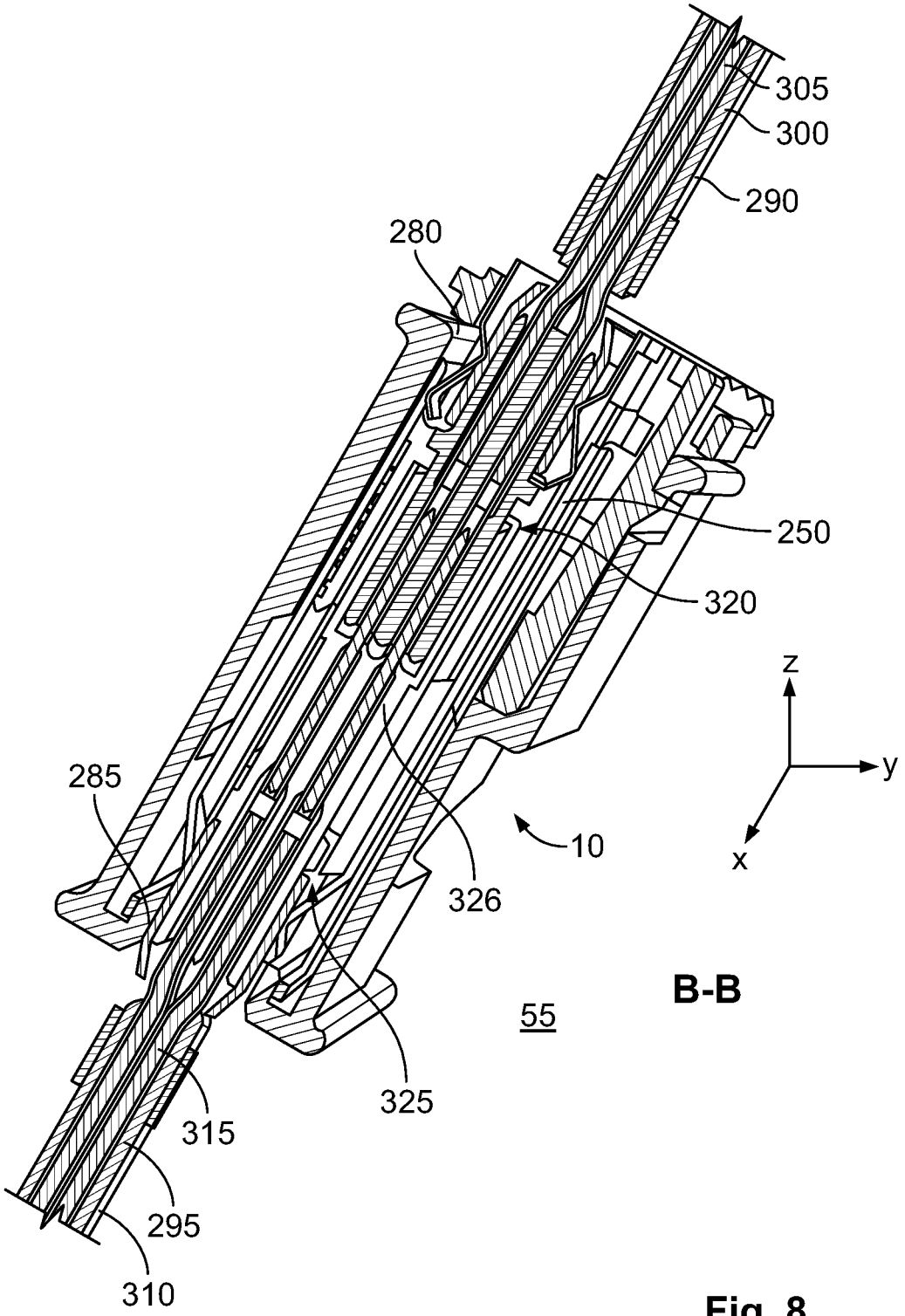
FIG. 8 is a sectional perspective view of the contact system, taken along plane B-B of FIG. 1.

As shown in FIG. 8, the first cable 290 has a first cable shield 300. The first cable shield 300 encloses one or more second electrical conductors 305 of the first cable 290 at the circumference. The first cable shield 300 is contacted by the shielding 250 of the second contact housing 50 and shields the second electrical conductor 305 from the environment 55.

The second cable 295, as shown in FIG. 8, is likewise formed as a shielded cable and has a second cable shield 310. The second cable shield 310 shields one or more third electrical conductors 315 of the second cable 295 from the environment 55. The second cable shield 310 is contacted by the shielding 250. The shielding 250 electrically connects the first cable shield 300 to the second cable shield 310.

The first cable 290, as shown in FIG. 8, has a third contact device 320 and the second cable 295 has a fourth contact device 325. The second contact device 20 has a connection unit 326. The connection unit 326 is arranged both in the first contact device receptacle 280 and in the second contact device receptacle 285.

The third contact device 320, as shown in FIG. 8, engages in the first contact device receptacle 280. The fourth contact device 325 engages in the second contact device receptacle 285. In an embodiment, the third contact device 320 and the fourth contact device 325 can be formed to be geometrically different from one another, and can be formed in such a way that the third contact device 320 cannot be plugged or contacted directly into the fourth contact device 325. The connection unit 326 undertakes the electrical connection between the third contact device 320 and the fourth contact device 325. In this case, the connection unit 326 contacts the third contact device 320 on one side and the fourth contact device 325 on the other side, and thus serves as a coupler between the third contact device 320 and the fourth contact device 325. The first shielded cable 290 can be connected, at the other side in relation to the second contact device 20, to a further electrical component, for example a first control apparatus (not shown). The second electrical cable 295 can be connected, at a side facing away from the second contact device 20, to a further electrical component, for example a further control apparatus.

The actuating unit 35 is depicted in the first position in FIG. 9. The actuating unit 35 is swiveled away and the first and second holding elements 140, 145 are arranged at a distance from the second contact housing 50.

As shown in FIG. 9, the first contact housing 30 has the first contact receptacle 345. The first contact receptacle 345 opens out at the fourth end face 190. The contact element 40 and a section of the earthing line 25, in particular the end region 210, are arranged in the first contact receptacle 345. The first contact receptacle 345 extends substantially in the longitudinal direction and runs parallel to the x-axis. The contact receptacle 345 is delimited on the lower side by the first housing element 166. The contact receptacle 345 is delimited laterally and on the upper side by the second housing element 195. Additionally, the first contact device 15 can have a fastening device 350, with the fastening device 350 fastening the contact element 40 in an interlocking manner in the first contact receptacle 345 and preventing the contact element 40 from being pulled out of the first contact receptacle 345, in particular in the x-direction.

In the first position of the actuating unit 35, as shown in FIG. 9, the contact spring 215 is arranged substantially in the first contact receptacle 345. The first contact housing 30 further has a first aperture 360 and a second aperture 365. The first aperture 360 is arranged in the first housing element 166. The first aperture 360 is formed as a through-hole and is arranged in an offset manner in relation to the third end face 167 and to the fourth end face 190. In this case, a distance from the first aperture 360 in the x-direction to the third end face 167 is smaller than to the fourth end face 190. The first aperture 360 connects the bearing surface 175 to the first contact receptacle 345. In this case, the first aperture 360 is arranged running in an inclined manner, perpendicular in an embodiment, in relation to the contact receptacle 345.

The second aperture 365 is arranged in the vertical direction opposite the first aperture 360. The second aperture 365 is likewise arranged in an inclined manner, perpendicular in an embodiment, in relation to the first contact receptacle 345. The second aperture 365 opens out at an upper side 355 of the first contact housing 30. The second aperture 365 is formed slimmer than the first aperture 360 in the x-direction.

The actuating unit 35 has an actuating section 370, as shown in FIG. 9. The actuating section 370 has a trapezoidal configuration in longitudinal section. The actuating section 370 is connected to the actuating bracket 125 by a third fixed end 375. The actuating section 370 is further arranged in a central location on the actuating bracket 125 in the transverse direction. The actuating section 370 is arranged between the swivel axis 120 and the first and second holding elements 140, 145. A long side 380 of the actuating section 370 is arranged at the third fixed end 375 of the actuating section 370. An actuating surface 390 is arranged at a short side 385 of the actuating section 370, which is arranged at a third free end 394 of the actuating section 370. The actuating surface 390 is formed in a planar manner and runs substantially parallel to the actuating bracket 125.

In the first position, the actuating surface 390 is arranged at a distance from the contact spring 215, in particular from the first spring section 235. As a result, the contact spring 215 is situated in the third position, in which the contact spring 215 is arranged at a distance from the shielding contact 255.

In addition, the actuating unit 35 can have at least one closure element 395 as shown in FIG. 9, with the closure element 395 being arranged on the actuating bracket 125 in a laterally offset manner in relation to the actuating section 370. The closure element 395 is formed in a corresponding manner to the second aperture 365. In an embodiment there are provided, on both sides in the transverse direction in an opposing manner, two closure elements 395 which are formed identically to one another. The closure elements 395 have a trapezoidal configuration in a lateral view.

Figure 10:
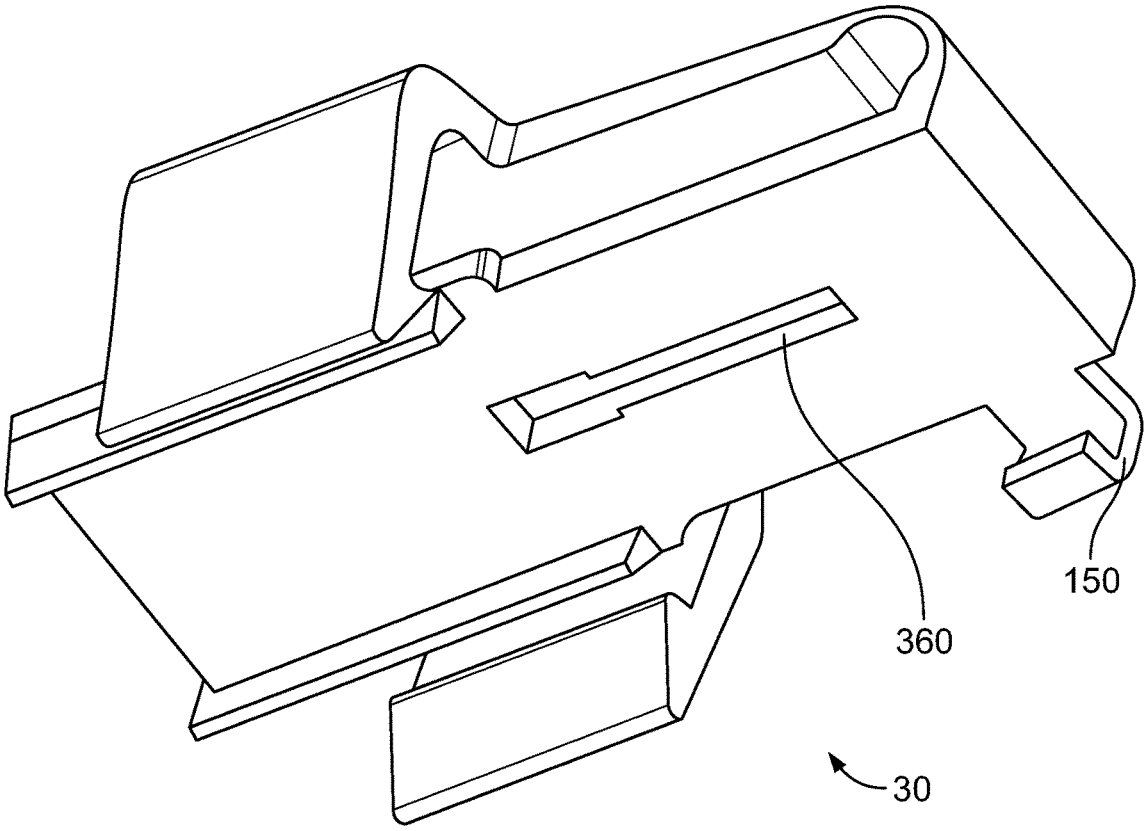
FIG. 10 is a bottom perspective view of the first contact housing.

As shown in FIG. 10, the first aperture 360 is formed in the shape of a slot and has a stepped portion in the transverse direction. Of course, the stepped portion can also be omitted in other embodiments. The third holding element 150 is arranged in the longitudinal direction between the first aperture 360 and the first fixed end 130 of the actuating bracket 125. The third holding element 150 is further formed in the shape of a hook, U-shaped in an embodiment.

Figure 11:
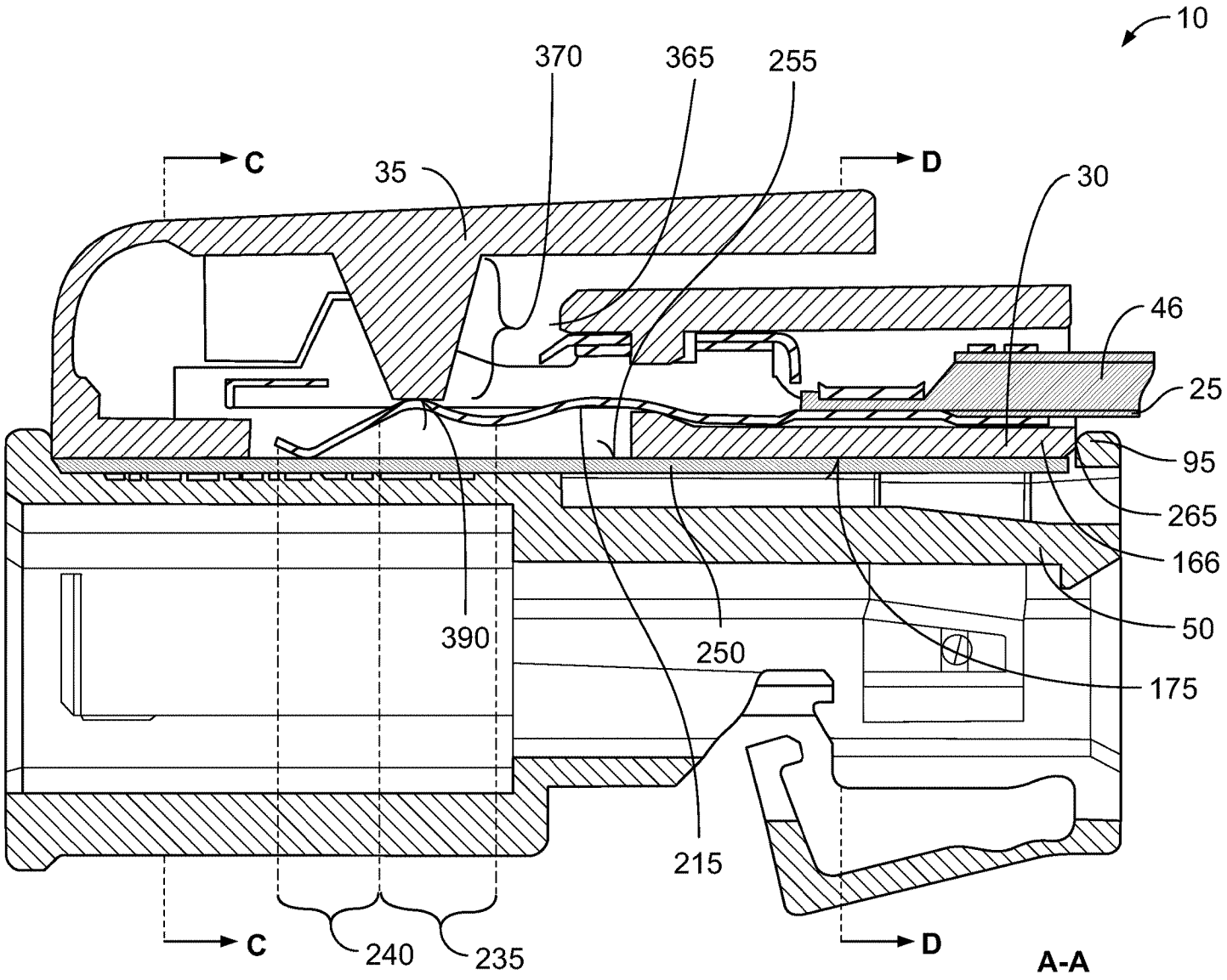
FIG. 11 is a sectional side view of the contact system, taken along plane A-A of FIG. 1.

The actuating unit 35 is situated in the second position in FIG. 11. In this case, the actuating section 370 engages through the second aperture 365 and adjoins the first spring section 235 on the upper side with the actuating surface 390. The actuating section 370 presses the contact spring 215 out of the third position into the fourth position. In the fourth position, the lower side of the second spring section 240 adjoins the upper side of the shielding contact 255 and electrically contacts the shielding contact 255. As a result, an electrical connection is provided between the shielding 250 and the first electrical conductor 46 of the earthing line 25 via the contact spring 215. This configuration has the advantage that, as a result, in the case of a large distance of the two control apparatuses from one another, an additional earthing contact is provided at the coupler (second contact device 20) between the first cable 290 and the second cable 295, so that a particularly good shielding and a particularly good earth contact are ensured.

In the mounted state, the first housing element 166 further engages in the receptacle 265 and adjoins the shielding contact 255 on the upper side with the bearing surface 175. The edge 95 engages around the first housing element 166 at the circumference and adjoins the first housing element 166 at the circumference. As a result, the edge 95 positions the first housing element 166 in the longitudinal direction and transverse direction and prevents the first contact housing 30 from slipping in relation to the second contact housing 50.

Figure 12:
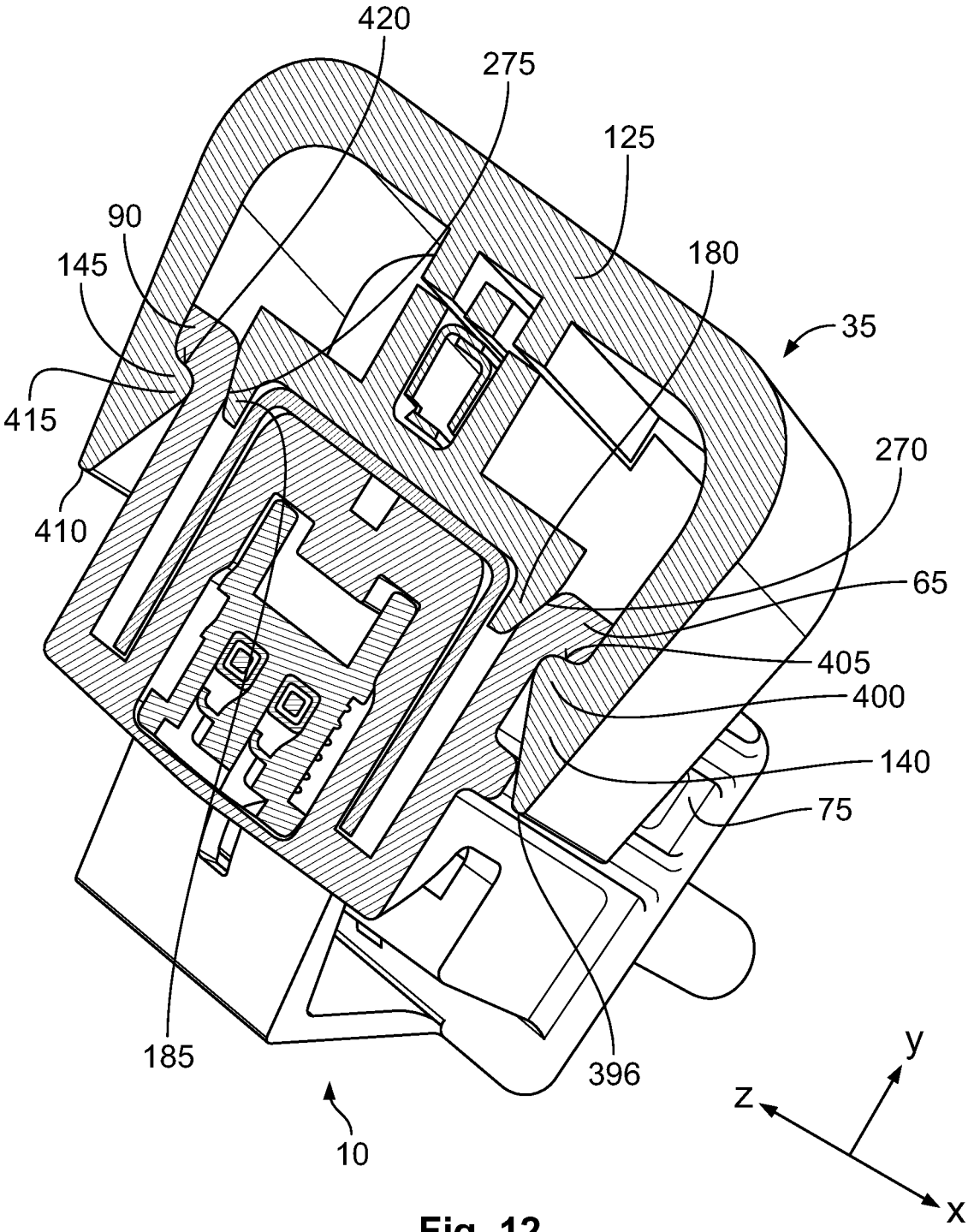
FIG. 12 is a sectional perspective view of the contact system, taken along plane D-D of FIG. 11.

The first holding element 140, as shown in FIG. 12, has a first latching nose 400 at a fourth free end 396. The first latching nose 400 has a first latching surface 405 on a side facing the actuating bracket 125. The second holding element 145 has a second latching nose 415 at a fifth free end 410. The second latching nose 415 has a second latching surface 420 on a side facing the actuating bracket 125. The first latching surface 405 and the second latching surface 420 are arranged in a common xy-plane.

In the second position, the first latching nose 400 engages behind the first housing protrusion 65 and engages in the housing receptacle 75. In this case, the first latching surface 405 adjoins the first housing protrusion 65 on the lower side and fastens and also holds the actuating unit 35 in the second position.

In the transverse direction in an opposing manner, the second holding element 145 likewise secures the position of the actuating unit 35, as shown in FIG. 12. In this case, the second latching nose 415 engages behind the third housing protrusion 90 and adjoins the third housing protrusion 90 on the lower side with the second latching surface 420. As a result, a tilting of the actuating unit 35, in particular of the actuating bracket 125, is avoided.

As shown in FIG. 12, the first holding bar 180 further engages in the first recess 270 and the second holding bar 185 engages in the second recess 275. By the corresponding configuration of the first holding bar 180 in relation to the first recess 270 and the corresponding configuration of the second holding bar 185 in relation to the second recess 275, in addition the first contact housing 30 is fastened to the second contact device 20 in the transverse direction and in the longitudinal direction.

Figure 13:
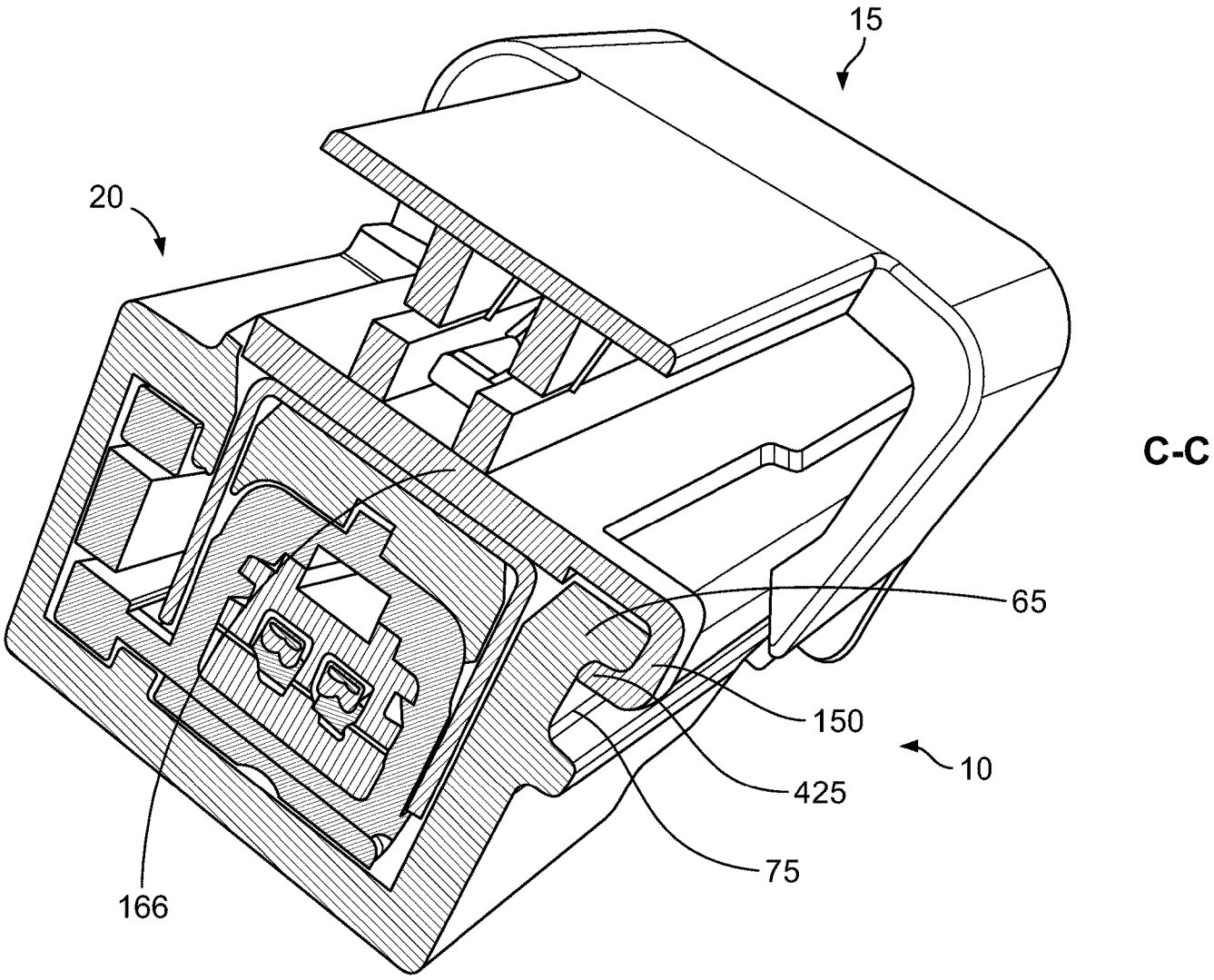
FIG. 13 is a sectional perspective view of the contact system, taken along plane C-C of FIG. 11.

In the mounted state of the first contact device 15 on the second contact device 20, the third holding element 150 engages the first housing protrusion 65 on the outside, as shown in FIG. 13. Bordering a sixth free end 425 of the third holding element 150, the third holding element 150 has a bearing surface 430 on a side facing the first housing element 166. The bearing surface 430 is formed in a planar manner and adjoins the first housing protrusion 65 on the lower side. In this case, the third holding element 150 engages in the housing receptacle 75 with the sixth free end 425.

In the contact system 10, in the case of long cables 290, 295 between the electrical components, in particular between two control apparatuses, an additional earthing can take place via the first contact device 15. As a result, a reliable shielding of the second and third electrical conductors 305, 315 is guaranteed. In this case, the first contact device 15 can be fastened to the second contact device 20 in a particularly simple manner by way of the actuating unit 35. In this regard, in particular a subsequent fastening of the first contact device 15 to the second contact device 20 is also possible.

By way of the three holding elements 140, 145, 150, a particularly good seating of the first contact device 15 on the second contact device 20 can be ensured. Furthermore, as a result of the actuation of the contact spring 215 in the second position by the actuating section 370, it is ensured that, insofar as the first contact device 15 is not fastened to the second contact device 20, the contact spring 215 is arranged in the contact enclosure 220. In this case, the contact spring 215 is also situated substantially in the first contact receptacle 345, so that the contact spring 215 is protected from damage. An unintentional contact of the contact spring 215 during the mounting of the first contact device 15 on the second contact device 20 is also avoided, until such time as the actuating unit 35 is swiveled fully from the first position into the second position. At the same time as the contacting, a reliable fastening of the first contact housing 30 to the second contact housing 50 by the actuating unit 35 is then also ensured, so that the mounting of the first contact device 15 on the second contact device 20 can take place particularly quickly and simply. Furthermore, the closure element 395 closes the second aperture 365 laterally, so that ingress of dirt into the second aperture 365 is avoided. Incorrect mounting, in particular by the engagement of the holding bar 180, 185 in the respectively associated recess 270, 275, is further avoided. In this case, the holding bar 180, 185 and the recess 270, 275 undertake an encoding function.

What is claimed is:

1. A first contact device for fastening to a second contact device of a contact system, comprising:

a first contact housing having a first contact receptacle;

an actuating unit adapted to be swiveled between a first position and a second position different from the first position, the first contact housing is connected to the actuating unit; and a contact element arranged in the first contact receptacle and electrically connected to an earthing line, the contact element has a contact spring, the contact spring is arranged in the first contact receptacle in the first position and, in the second position, the actuating unit adjoins the contact spring, the contact spring is swiveled at least partially out of the first contact receptacle and contacts a shielding contact of the second contact device.

2. The first contact device of claim 1, wherein the first contact housing has a bearing surface on a lower side and a first aperture, the first aperture connects the first contact receptacle to the bearing surface.

3. The first contact device of claim 2, wherein the contact spring engages through the first aperture in the second position.

4. The first contact device of claim 3, wherein the first contact housing has a second aperture arranged in an inclined manner in relation to the first contact receptacle.

5. The first contact device of claim 4, wherein the second aperture opens out at an upper side of the first contact housing on a first side of the second aperture and, on a second side of the second aperture, the second aperture opens out at the first contact receptacle.

6. The first contact device of claim 5, wherein the actuating unit closes the second aperture at least partially in the second position.

7. The first contact device of claim 6, wherein the actuating unit has an actuating section, the actuating section passes through the second aperture in the second position and, with an actuating surface arranged at a free end of the actuating section, presses the contact spring into the first aperture.

8. The first contact device of claim 1, wherein the actuating unit has an actuating bracket connected at a first fixed end to the first contact housing in an articulated manner around a swivel axis.

9. The first contact device of claim 8, wherein the actuating bracket can be swiveled between the first position and the second position around the swivel axis, the actuating bracket is arranged at a distance from the first contact housing in the first position and the actuating bracket is folded onto the first contact housing in the second position.

10. The first contact device of claim 9, wherein the actuating unit has a first holding element arranged laterally at a first side of the actuating bracket and connected to the actuating bracket, the first holding element engages behind a first housing protrusion of a second contact housing of the second contact device in the second position of the actuating unit.

11. The first contact device of claim 10, wherein the actuating unit has a second holding element arranged laterally at a second side of the actuating bracket opposite the first side and connected to the actuating bracket, the second holding element engages behind a second housing protrusion of the second contact housing in the second position of the actuating unit.

12. The first contact device of claim 11, wherein the first holding element has a latching nose at a free end.

13. The first contact device of claim 12, wherein the latching nose has a first latching surface on a side facing the actuating bracket, the first latching surface holds the actuating bracket in the second position by adjoining the first housing protrusion.

14. The first contact device of claim 11, wherein the first contact housing has a third holding element formed in a shape of a hook.

15. The first contact device of claim 14, wherein the first holding element and the third holding element are arranged on a common side of the first contact device, the third holding element engages around the first housing protrusion.

16. The first contact device of claim 15, wherein the third holding element is arranged between the first aperture and the first fixed end of the actuating bracket.

17. The first contact device of claim 10, wherein the actuating unit has an actuating section arranged between the swivel axis and the first holding element, the actuating section has an actuating surface arranged at a free end of the actuating section.

18. The first contact device of claim 17, wherein a long side of the actuating section is arranged at a fixed end of the actuating section and the actuating section is connected to the actuating bracket by the fixed end.

19. The first contact device of claim 18, wherein a short side of the actuating section is arranged on the actuating surface.

20. The first contact device of claim 19, wherein the actuating section has a trapezoidal configuration.

21. The first contact device of claim 2, wherein the contact spring has a first spring section and a second spring section connected to the first spring section, the first spring section and the second spring section each have an oppositely running curvature and the second spring section is formed in a convex manner with respect to the first spring section.

22. The first contact device of claim 21, wherein, in the second position, the actuating unit adjoins an upper side of the first spring section and the second spring section engages through the first aperture and adjoins a lower side of the shielding contact of the second contact device.

23. A contact system, comprising:

a first contact device including a first contact housing having a first contact receptacle, an actuating unit adapted to be swiveled between a first position and a second position different from the first position, the first contact housing is connected to the actuating unit, and a contact element arranged in the first contact receptacle and electrically connected to an earthing line, the contact element has a contact spring, the contact spring is arranged in the first contact receptacle in the first position and, in the second position, the actuating unit adjoins the contact spring; and a second contact device including a second contact housing and a shielding, the second contact housing has a second contact receptacle and the shielding is arranged in the second contact receptacle, the shielding has a shielding contact arranged on an outside of the second contact housing, the first contact device is fastened to the second contact device, the contact spring is arranged at a distance from the shielding contact in the first position and, in the second position, the actuating unit presses the contact spring onto the shielding contact and the contact spring forms an electrical contact with the shielding contact.

24. The contact system of claim 23, wherein the shielding contact is formed at least partially in a shape of a plate.

25. The contact system of claim 23, wherein the second contact housing has an edge at a circumference of the shielding contact, the edge and the shielding contact delimit a receptacle, the edge adjoins the first contact housing.

26. The contact system of claim 25, wherein the first contact housing is arranged partially in the receptacle and adjoins the shielding contact with a bearing surface.

27. The contact system of claim 23, wherein the actuating unit has a first holding element and the second contact housing has a first housing protrusion, the first holding element engages behind the first housing protrusion and fastens the first contact device to the first housing protrusion.

28. The contact system of claim 27, wherein the second contact housing has a third housing protrusion arranged on an opposite side of the second contact housing from the first housing protrusion.

29. The contact system of claim 28, wherein the first housing protrusion and the third housing protrusion are each formed in a shape of a rib and extend in common plane, the first housing protrusion and the third housing protrusion extend parallel to one another.

30. The contact system of claim 28, wherein the actuating unit has a second holding element and the first contact housing has a third holding element, the third holding element engages the first housing protrusion and the second holding element engages the third housing protrusion.

* * * * *